United States Patent [19]

Rosemeier et al.

[11] 4,350,284

[45] Sep. 21, 1982

[54] TRANSFERRING MEANS FOR USE IN A DEVICE FOR SEPARATING LIQUIDS

[75] Inventors: Friedrich Rosemeier; Helmut Kerber, both of Hechingen, Fed. Rep. of Germany

[73] Assignee: Gambro Dialysatoren KG, Fed. Rep. of Germany

[21] Appl. No.: 191,253

[22] Filed: Sep. 26, 1980

[30] Foreign Application Priority Data

Sep. 28, 1979 [DE] Fed. Rep. of Germany ..... 7908037

[51] Int. Cl.[3] ..... B04B 1/00

[52] U.S. Cl. ..... 233/27

[58] Field of Search ..... 233/19 R, 26, 27, 28, 233/21, 22

[56] References Cited

U.S. PATENT DOCUMENTS

| | | | |
|---|---|---|---|
| 432,719 | 7/1890 | Von Bechtolsheim | 233/28 |
| 2,179,941 | 11/1939 | Lindgren | 233/27 |
| 3,489,145 | 1/1970 | Judson et al. | 233/19 R X |
| 3,519,201 | 7/1970 | Eisel et al. | 233/21 |
| 4,120,448 | 10/1978 | Cullis | 233/22 |

*Primary Examiner*—Billy J. Wilhite

*Attorney, Agent, or Firm*—Lerner, David, Littenberg & Samuel

[57] ABSTRACT

A device is disclosed for collecting a liquid which has been separated into at least first and second fractions according to the densities of such fractions. The device comprises a stationary transferring element and a housing for said stationary transferring element. The housing is rotatable about an axis of rotation for the device and the housing and stationary transferring element provide a fluid communication space therebetween for fluid communication between the housing and stationary transferring element. The housing includes first and second outlet passages for passing said first and second separated fractions through the housing to first and second points in the fluid communication space, and the transferring element includes first and second outlet channels for passing the first and second separated fractions from the first and second points in fluid communication space through the transferring element. The first point of communication in the fluid communication space is positioned radially outwardly from the axis of rotation of the device with respect to said second point in said fluid communication space so that when the housing is rotating the separation of the first and second fractions in the fluid communication space is maintained at least partially by centrifugal force.

8 Claims, 1 Drawing Figure

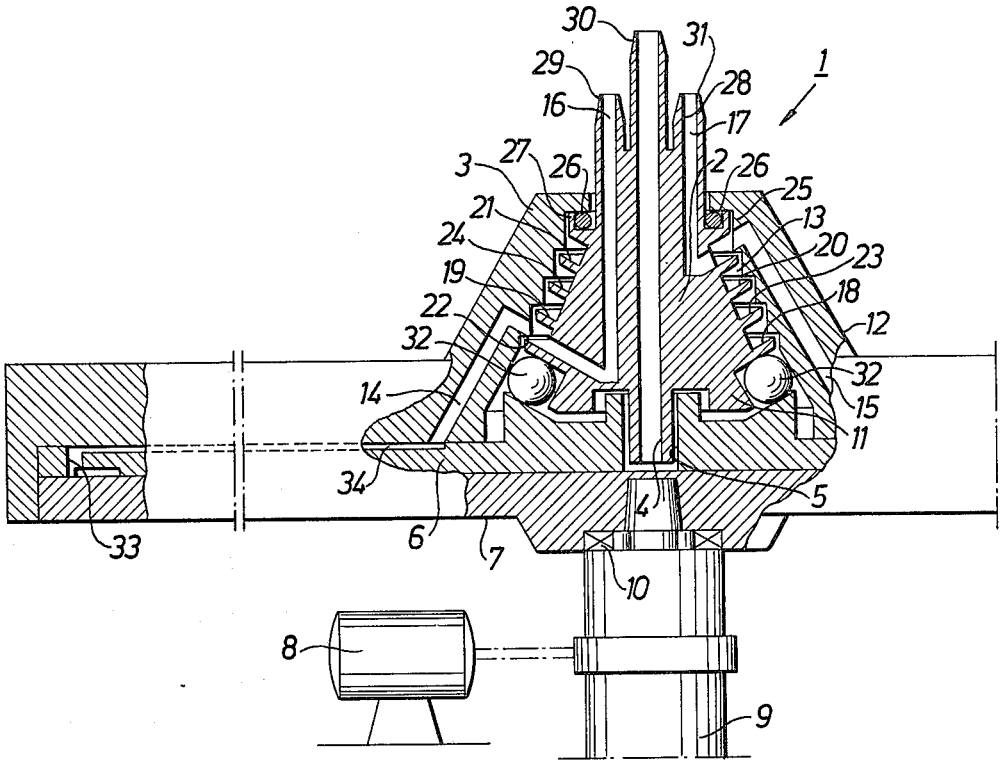
30
31
29
28
1
16
17
3
27
26
2
26
25
21
13
24
20
23
19
18
22
12
32
32
14
15
11
34
5
4
33
6
7
10
8
9

TRANSFERRING MEANS FOR USE IN A DEVICE FOR SEPARATING LIQUIDS

BACKGROUND OF THE INVENTION

This invention relates in general to a device for separating a liquid, especially whole blood, into fractions having different densities. More particularly, the invention relates to a transferring means for introducing the liquid to be separated and for withdrawing the separated fractions.

Certain transferring means for use in a device of the above-identified kind are known, e.g., through the Swedish Patent Application No. 77.04127-5 or U.S. Pat. No. 3,489,145. These known transferring means are complicated and necessarily involve special means to prevent interleaking between the separated fractions. Furthermore, such known transferring means involve a stationary surface in direct slidable contact with a rotatable surface, whereby it may be necessary to provide for cooling to avoid excessive heat due to friction between the contact surfaces.

SUMMARY OF THE INVENTION

It has now been found that these disadvantages can be eliminated or minimized by a transferring means having a simple construction which comprises a stationary transferring element and a housing for said stationary transferring element, wherein the housing is rotatable about an axis of rotation for the device, the housing and stationary transferring element provide a fluid communication space therebetween for fluid communication between the housing and stationary transferring element, the housing includes first and second outlet passages for passing first and second separated fractions, where the first fraction has a higher density than the second fraction, through the housing to first and second points in the fluid communication space, and the transferring element includes first and second outlet channels for passing the first and second fractions from the first and second points in the fluid communication space through the transferring element, and wherein the first point in the fluid communication space is positioned radially outwardly from the axis of rotation of the device with respect to the second point in the fluid communication space so that, when the housing is rotating, the separation of the first and second fractions in the fluid communication space is maintained at least partially by centrifugal force. Such transferring means thus avoids direct contact between a stationary surface and a rotatable surface, while maintaining a high degree of separation efficiency. Preferably, more than two separated fractions can be transferred by this device, which would then include additional corresponding outlet passages and channels for each such fraction, each with a corresponding fluid communication point positioned radially, with the fluid communication point for each successively denser separated fraction being located radially outwardly with respect to each progressively less dense fraction.

In a preferred embodiment, the present device for separating a liquid, especially whole blood, into fractions having different densities comprises transferring means for introducing of the liquid to be separated and for withdrawing of the separated fractions. The transferring means preferably includes a rotatable housing in fluid communication with a stationary transferring element. The device is characterized in that outlet passages in the housing and corresponding outlet channels in the transferring element open into a common space between the housing and the transferring element, in which space separation of the separated liquid is maintained at least partially through centrifugal force in that the passages and channels are in fluid communication with each other at different radial distances from the rotation axis of the device and in that the outlet passage and the corresponding outlet channel for the heaviest fraction are in fluid communication with each other at the radially outermost distance from such axis.

By having the outlet passage and the corresponding outlet channel for the heaviest or densest fraction in fluid communication with each other at the radially outermost distance from the axis of rotation (and consequently by having the outlet passage and the corresponding outlet channel for the lightest fraction in fluid communication with each other at the radially innermost distance from such axis), any tendency toward interleaking between the separated fractions is generally prevented through the centrifugal force acting on the separated fractions in the common space between the housing and the transferring element. In this manner, it is possible to use one and the same space for each of the separated fractions in transferring the separated fractions from the rotatable housing into the stationary transferring element, thus avoiding unnecessary direct contact between a rotatable surface and a stationary surface. Especially in the separating of whole blood into a plasma-rich fraction and a plasma-poor fraction, where pure plasma is required, a high degree of separation efficiency can be sufficiently maintained by having the outlet passage and the corresponding outlet channel for the plasma-rich fraction at the radially innermost distance from the rotation axis and by having the corresponding outlet channel for the plasma-poor fraction at a sufficient radial distance from the former outlet channel, without the use of seals between the two fractions in said common space.

In another preferred embodiment, the outlet passages and the outlet channels for the separated fractions, and thus, the first and second points in said fluid communication space, are located at different height levels along the axis of rotation. That is, the outlet passage and outlet channel, and therefore the corresponding communication point in the fluid communication space for each successively heavier or denser separated fraction is lower than for the next most dense separated fraction, with the outlet passage and outlet channel for the heaviest fraction are in communication at the lowermost level. Therefore, a tendency of interleaking or mixing between the separated fractions is further reduced by the gravity force tending to maintain the heaviest or densest fraction at the lowermost level.

In accordance with still another preferred embodiment of the invention, the transferring element includes a generally conically tapered main body, and the housing includes a corresponding tapered portion surrounding the conically shaped tapered body, define therebetween the fluid communication space. In separating whole blood the outlet passage and the corresponding outlet channels for the plasma-rich fraction are thus in fluid communication with each other at the narrower section of the main body, and the outlet passage and corresponding outlet channel for the plasma-poor fraction are in fluid communication at the wider section of the main body. In separating of whole blood into more fractions, e.g., red cells, white cells, buffy-coat and plasma, it is convenient to have the outlet passages and corresponding outlet channels for each of these fractions at radially increasing distances from the rotation axis, so that the outlet passage and corresponding outlet channel for the plasma are in fluid communication with each other at the radially innermost distance from said axis.

Preferably, a plurality of uninterrupted annular flanges project from the entire periphery of the main body of the transferring means at each of the above discussed height levels. A plurality of corresponding inwardly extending shelves project from the housing and terminate at a short distance from such flanges so as to aid in or support the maintenance of the separation of the separated fractions within the fluid communication space. The flanges, which may be intergrally formed with the main body, serve as collection pockets for the respective fractions from the corresponding outlet passages in said housing. The term "short" distance is intended to mean a distance which is small yet large enough to let the biggest component of whole blood pass freely between said flanges and shelves, e.g., 0.1–0.2 mm.

The transferring means according to the present invention are preferably used in connection with a separation unit of the kind described in our copending U.S. application Ser. No. 191,254, filed on Sept. 26, 1980 entitled "A Device For Separating Liquids, Especially Whole Blood", corresponding to Swedish Patent Application No. 79.08036-2 filed Sept. 28, 1979, the disclosure of which applications is incorporated herein by reference.

The transferring means also preferably includes a centrally located, vertical inlet channel. In such an embodiment, the outlet channels in the transferring element are preferably symmetrically located with respect to the inlet channel.

The inlet channel and the outlet channels from the transferring means preferably terminate in connection nipples outside the body of the transferring means. These nipples preferably have an outer conically tapered shape.

In general, the separation unit is formed as a rigid circular disc having an elongated, curved groove formed at or on one surface thereof and serving as a separation chamber or channel such as the disc disclosed in our copending U.S. application mentioned above. The groove may comprise a central semi-circular inlet part in fluid communication with a peripheral main portion concentric to the center of the disc. Preferably, the main portion is extended by a radially inwardly curved end portion.

In the peripheral main portion and/or the curved end portion of the groove, there are separate outlet holes in communication with slits or channels on the other side of the disc for withdrawing of the separated fractions. For further details as regards said separation unit, reference is made to our copending U.S. application mentioned above.

In assembling a suitable device for separating a liquid, especially whole blood, according to the present invention, the separation unit is placed on the top surface of planar supporting means, which supporting means are adapted to cover the groove in the disc and may be rotated by means of a motor via a drive-shaft received in a suitable seat on the other surface of the supporting means. Preferably, the disc is centrally located on the supporting means and has its inlet opening or bore in fluid communication with the vertical drive-shaft.

The transferring element having inlet and outlet channels is preferably centrally located on the disc by means of a suitable bearing so as to provide fluid communication between the inlet channel of the transferring element and the groove of the disc.

The package of supporting means, disc and transferring element is covered by a housing having outlet passages in fluid communication with the slits or channels on the top surface of the disc and with the corresponding outlet channels in the transferring element. The housing is attached in a fluid-tight manner to the disc and is preferably sealed around the outer periphery of the disc and the supporting means.

The transferring element is adapted to be held stationary during the rotation of the supporting means, disc and housing. This can be achieved by means of a suitable bearing, such as a glass ball-bearing received in a seating between the housing, disc and supporting means at the bottom of the transferring element. To prevent outer leakage, a seal between the transferring element and the housing may be provided at an upper end of said transferring element.

Being so assembled, the combination of supporting means, separation unit or disc, housing and transferring element may be mounted on any already existing rotatable shaft by merely modifying the seat of the supporting means to fit the driving shaft, if necessary. A major advantage of this combination is that it may be formed as a disposable package, already assembled, for immediate use. This is advantageous, since the user of the device merely has to connect a suitable tubing to the inlet and outlet channels of the transferring element, when the device has been mounted on the rotatable shaft.

BRIEF DESCRIPTION OF THE DRAWING

For further details of the present device, reference is made to the following description taken in connection with the accompanying drawing showing a partially broken cross-sectional view of a preferred embodiment of the present device, including a preferred transferring means.

DETAILED DESCRIPTION OF THE INVENTION

As is shown in the drawing, the present device 1 according to a preferred embodiment comprises a stationary transferring element 2 which is centrally located within a surrounding housing 3. A vertical inlet channel 4 in the transferring element 2 is in fluid communication with an inlet opening 5 of a rotatable separation unit 6. The separation unit 6 is supported on rotatable supporting means 7 and clamped between the housing 3 and the supporting means 7.

The supporting means 7 may be driven by means of a motor 8 via a suitable drive-shaft 9 received in a seat 10 on the bottom surface of the supporting means 7.

As can be seen, a preferred transferring element 2 comprises a conically tapered main body 11 surrounded by a similarly conically tapered portion 12 of the housing to define therebetween an annular space 13.

Outlet passages 14 and 15 in the housing are in fluid communication with corresponding outlet channels 16 and 17 in the transferring element via the annular space 13.

In the drawing, the outlet passage 14 for the heavy or dense fraction of the liquid to be separated is in fluid communication with the corresponding outlet channel 16 of the transferring element 2 at a lower height level of the main body 11 as compared to that of the fluid communication between the outlet passage 15 and the corresponding outlet channel 17 for the light or less dense fraction of the liquid. More precisely, the outlet passage 14 and the corresponding outlet channel 16 for the heavy fraction are in fluid communication at a point where the centrifugal force is greater than the centrifugal force acting on the point where the outlet passage 15 and the corresponding outlet channel 17 for the light fraction are in fluid communication.

As is apparent, the device shown is adapted for separating of a liquid, especially whole blood, into two fractions having different densities, such as plasma-rich fraction and a plasma-poor fraction. It is, however, to be noted that said device also may be used for separating of a liquid, such as whole blood, into more fractions, e.g., red cells, white cells, buffy-coat and plasma, by providing two or more further outlet channels (not shown) in the transferring element 2 and two or more further corresponding outlet passages (not shown) in the housing 3. The two or more further outlet channels thereby are conveniently provided in fluid communication with the two or more further corresponding outlet passages at separate height levels between the upper and lower height levels illustrated in the drawing. For example, such a further outlet passage and a corresponding further outlet channel for the white cells can be in fluid communication with each other at a lower height level than that of the fluid communication between the further outlet passage and corresponding further outlet channel for the buffy-coat.

At each of said height levels an annular outwardly extending flange 18–21 may be provided around the entire periphery of said main body 11. Similarly, corresponding inwardly extending shelves 22–25 on the housing are provided to terminate at a short distance from the flanges 18–21 to support or aid in the maintenance of the separation within the common space 13. The annular flanges 18–21 thus serve as suitable collecting pockets for each of the separated fractions.

To prevent outer leakage of plasma-rich fraction from the space 13 between the housing 3 and the transferring element 2 there is provided a seal, such as as O-ring 26 received in a suitable seat 27 at the top of the space between the housing and the transferring element.

As is shown in the drawing, the transferring element comprises an outwardly extending top portion 28 comprising separate conically tapered connecting nipples 29–31 to be connected to a suitable tubing (not shown) to provide fluid communication between a source for the liquid to be separated and the inlet channel 4 of said transferring element 2 and between separate collection points for the separated fractions and the respective outlet channels 16 and 17 of the transferring element.

As is further shown in the drawing, a suitable bearing, such as glass balls 32, can be provided between the housing 3, disc 6 and supporting means 7 at the bottom of the transferring element.

In use the combination or package of supporting means 7, disc 6, housing 3 and transferring element 2 is mounted upon a drive-shaft 9 by means of a suitable bearing 10 on the bottom surface of the supporting means, wherein the drive-shaft 9 is rotated by means of any suitable motor 8 or driving means. Whole blood to be separated is pumped or otherwise introduced into the inlet channel 4, which preferably is vertical and centrally located, of the stationary transferring element 2 and passed into the separation unit 6 for separation into a plasma-rich fraction and a plasma-poor fraction. The separated plasma-poor fraction is withdrawn from the separation unit through an outlet opening 33 and associated slit 34 of said separation unit, the outlet passage 14 in the housing 3 and the outlet channel 16 in the transferring element 2 via the space 13 between the housing and transferring element. The plasma-rich fraction, on the other hand, is withdrawn through a similar outlet hole (not shown) and slit of the separation unit (not shown), the outlet passage 15 in the housing and the corresponding outlet channel 17 in the transferring element via the space 13.

As explained above, any part of the plasma-poor fraction that tends to flow upwardly in the space 13 between the housing and the transferring element is automatically forced downwardly towards the lowermost collection pocket due to the greater centrifugal force acting at the pocket as a consequence of the radially greater distance from the rotation axis.

It will be understood that the embodiments described herein are merely exemplary and that a person skilled in the art may make many variations and modifications without departing from the spirit and scope of the invention. All such modifications and variations are intended to be included within the scope of the invention as defined in the appended claims.

What is claimed is:

1. A device for collecting a liquid which has been separated into at least first and second fractions, said first fraction having a higher density than said second fraction, said device comprising a stationary transferring element and a housing for said stationary transferring element, said housing being rotatable about an axis of rotation for said device, said housing and said stationary transferring element providing a fluid communication space therebetween for fluid communication between said housing and said stationary transferring element, said housing including first and second outlet passages for passing said first and second separated fractions through said housing to first and second points in said fluid communication space, and said transferring element including first and second outlet channels for passing said first and second separated fractions from said first and second points in said fluid communication space through said transferring element, and wherein said first point in said fluid communication space is positioned radially outwardly from the axis of rotation of said device with respect to said second point in said fluid communication space so that when said housing is rotating the separation of said first and second fractions in said fluid communication space is maintained at least partially by centrifugal force.

2. A device according to claim 1, wherein the outlet passages and said first and second points in said fluid communication space are located at different levels of height along said axis of rotation, said first point being lower than said second point.

3. A device according to claim 2, wherein said transferring element includes a substantially conically shaped tapered body, and said housing includes a correspondingly tapered portion surrounding said substantially conically shaped tapered body, said conically tapered body and said tapered portion of said housing defining said fluid communication space therebetween.

4. A device according to claim 3, including a plurality of annular flanges projecting from the periphery of said substantially conically tapered body of said transferring element, and a plurality of correspondingly inwardly extending shelves projecting from said housing, said shelves cooperating with said flanges to aid in the maintenance of the separation of said separated fractions within said fluid communication space.

5. A device according to claim 4, including said annular flanges being positioned at least at said levels of height corresponding with said first and second points.

6. A device according to claim 4 or 5, wherein said transferring element comprises a centrally located, vertical inlet channel for introduction of the liquid to be separated and wherein said first and second outlet channels are symmetrically located with respect to said inlet channel.

7. A device according to claim 6, wherein said inlet channel and said first and second outlet channels terminate in connection nipples outside the body of the transferring element.

8. A device according to claim 7, wherein said connection nipples have an outer conically tapered shape.

* * * * *